United States Patent [19]

Billings et al.

[11] 4,040,398

[45] Aug. 9, 1977

[54] FOUR-CYCLE ROTARY ENGINE AND METHOD OF OPERATION THEREFOR

[75] Inventors: Roger Evan Billings; Franklin Earl Lynch, both of Provo, Utah

[73] Assignee: Engine Research, Provo, Utah

[21] Appl. No.: 638,665

[22] Filed: Dec. 8, 1975

[51] Int. Cl.[2] ..... F02B 57/08

[52] U.S. Cl. ..... 123/44 R

[58] Field of Search ..... 123/44 R, 44 E, 44 B, 123/44 D

[56] References Cited

U.S. PATENT DOCUMENTS

| | | | |
|---|---|---|---|
| 2,419,787 | 4/1947 | Muffly | 123/44 X |
| 2,683,422 | 7/1954 | Richards | 123/44 R |
| 3,220,390 | 11/1965 | Grunstra | 123/44 C |
| 3,292,603 | 12/1966 | Wayto | 123/44 D |
| 3,857,371 | 12/1974 | Gibson | 123/44 R |

FOREIGN PATENT DOCUMENTS

| | | | |
|---|---|---|---|
| 23,869 | 10/1915 | United Kingdom | 123/44 R |
| 2,906 | 2/1916 | United Kingdom | 123/44 R |
| 11,720 | 8/1915 | United Kingdom | 123/44 R |

*Primary Examiner*—Clarence R. Gordon
*Attorney, Agent, or Firm*—Criddle, Thorpe & Western

[57] ABSTRACT

Apparatus for four-cycle rotary engine operation includes a cylinder block rotatable about a first axis and having six cylinders uniformly spaced and radially arranged about the axis, a set of six pistons rotatable about a second axis which is offset from and parallel with the first mentioned axis, each piston being disposed to move in a different one of the cylinders, and a valve system for introducing fuel charges into and exhausting combustion products from the cylinders. A crankshaft extends within the cylinder block and is coupled to the pistons to rotate as the cylinder block rotates and as the pistons move in their respective cylinders. The fuel charges are successively fired in alternate pairs of adjacent cylinders to cause the cylinder unit and crankshaft to rotate in a smooth and efficient manner.

7 Claims, 10 Drawing Figures

FOUR-CYCLE ROTARY ENGINE AND METHOD OF OPERATION THEREFOR

BACKGROUND OF THE INVENTION

This invention relates to four-cycle rotary engines and methods of operating same and more particularly to a method and structure for firing such engines.

There is a continuing interest in finding practical alternatives to the standard reciprocating internal combustion engine with much of this interest being focused on rotary engine research and development. Numerous types of rotary engines have been proposed including engines which do not utilize the conventional cylinder/piston construction, such as the well known Wankel engine, as well as engines which utilize a cylinder/-piston construction but in an unconventional way, such as the engine disclosed in A. Z. Richards, Jr., U.S. Pat. No. 2,683,422. The latter type engine includes a cylinder unit or block having a plurality of cylinders radially arranged about an axis about which the block rotates. Pistons are disposed to move in the cylinders and also to rotate about a second axis offset and generally parallel with the first mentioned axis.

In a two-cycle Richards-type engine, the firing order would be predetermined by the nature of the operation, i.e., those cylinders to be fired would be fired in succession with every revolution of the cylinder block. In a four-cycle Richards-type engine, on the other hand, the cylinders to be fired would be fired on every other revolution of the cylinder block; thus a variety of firing orders are at least theoretically possible in the four-cycle engine depending upon the number of cylinders in the engine. The most obvious firing order in the four-cycle engine, and the one which can be employed in all such four-cycle engines regardless of the number of cylinders, is one in which all of the cylinders are fired in sequence during one revolution of the cylinder unit, then none of the cylinders are fired during the next revolution, etc. This is the firing order suggested in the aforecited Richards patent.

Since the firing order of the cylinders in any type engine employing cylinders and moving pistons affects the smoothness of operation of the engine as well as the amount of power developed, determination of the firing order is of critical importance. For example, the firing of each cylinder in sequence during one revolution and then the exhaustion of combustion products during the next revolution, etc., as described above, would result generally in an uneven, irregular power development especially at low r.p.m.

SUMMARY OF THE INVENTION

It is an object of the present invention to provide a method and apparatus for firing a four-cycle rotary engine to produce a smooth and even power development.

It is also an object of the present invention to provide a novel method and sequence for firing a six, ten, fourteen, etc., cylinder, four-cycle rotary engine of the type described to produce optimum power output.

It is a further object of the present invention to provide ignition apparatus for igniting fuel charges successively in alternate pairs of adjacent cylinders of a four-cycle rotary engine having a rotatable cylinder unit which includes $N=6, 10, 14, ..$ cylinders uniformly and radially arranged about the axis of rotation.

The above and other objects of the invention are realized in an illustrative method of firing fuel charges introduced into the cylinders of a four-cycle rotary engine having a cylinder block rotatable about a first axis and defining six cylinders radially arranged therein. The rotary engine also includes a set of six pistons, each disposed to move in a different one of the cylinders as the cylinder unit rotates, and a crankshaft coupled by piston rods to the pistons and disposed to rotate as the cylinder unit rotates. Fuel charges are successively introduced into alternate pairs of adjacent cylinders, ignited, and then exhausted from the cylinders. By firing alternate pairs of adjacent cylinders in such a rotary engine, an exceptionally smooth and even power development is accomplished. Every cylinder in the engine is fired on every other revolution of that cylinder.

The method of successively igniting fuel charges in alternate pairs of adjacent cylinders can also be utilized in rotary engines of the type described having 10, 14, 18, etc., cylinders radially arranged in a rotatable cylinder unit.

BRIEF DESCRIPTION OF THE DRAWINGS

The objects, features and advantages of the present invention will become apparent from the following detailed description presented in connection with the accompanying drawings in which.

DETAILED DESCRIPTION

Figure 1:
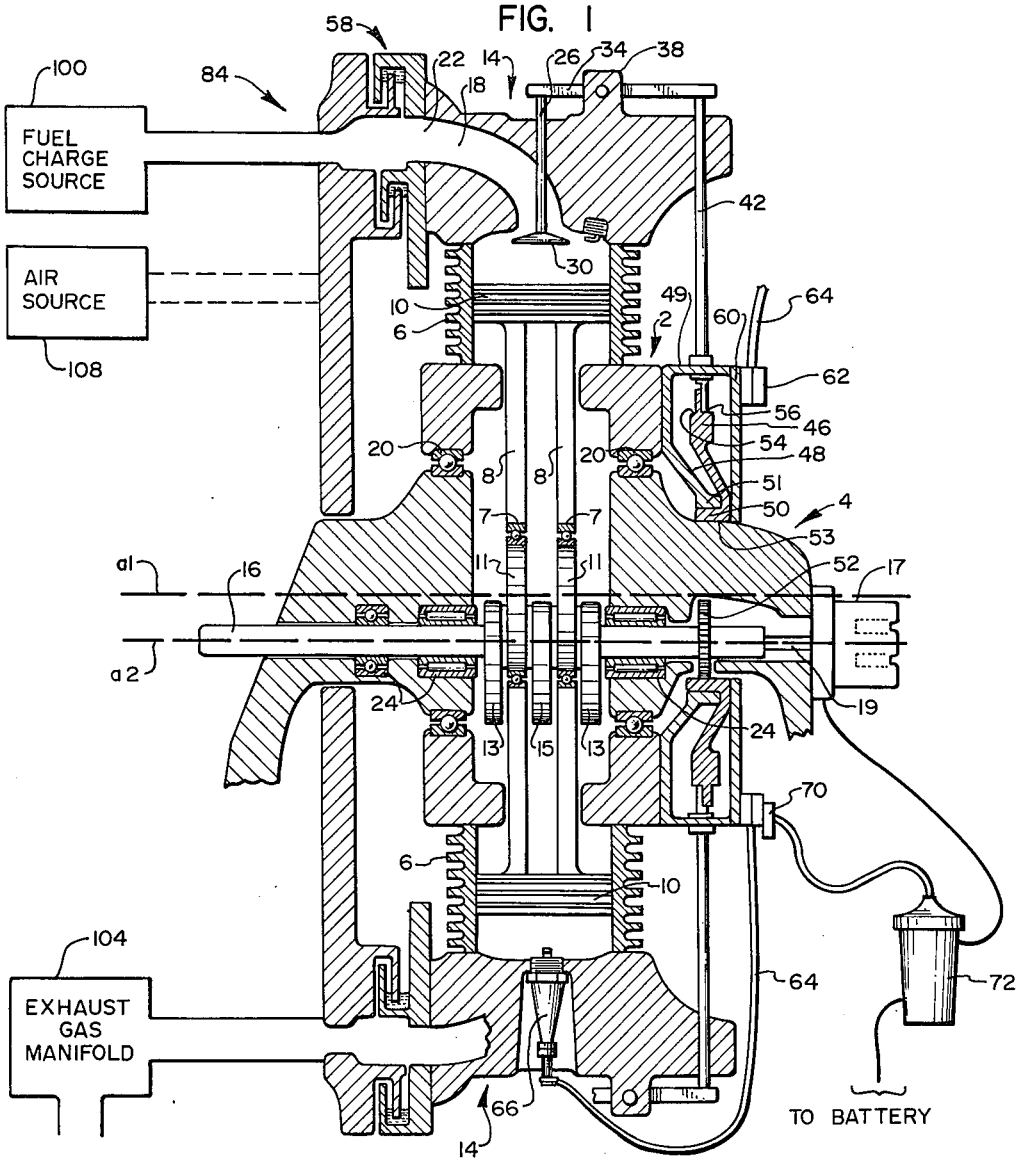
FIG. 1 shows a side cross-sectional view of a four-cycle rotary engine adapted to operate in accordance with the principles of the present invention.
Figure 3:
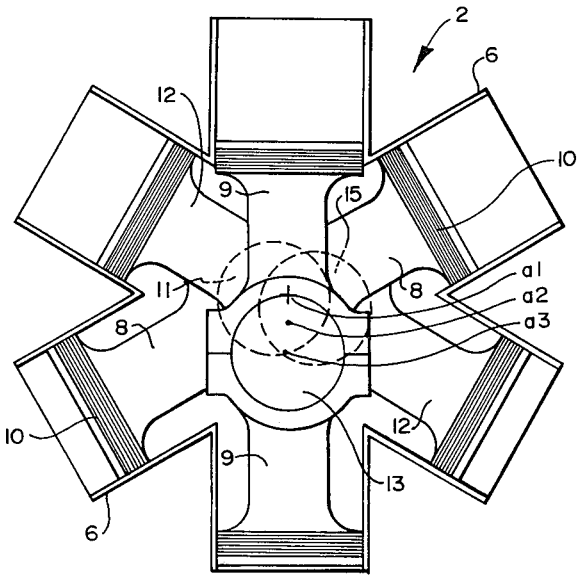
FIG. 3 shows a front cross-sectional view of a portion of the rotary engine of FIG. 1.

FIG. 1 is a side cross-sectional view of one illustrative embodiment of a rotary engine adapted to operate in accordance with the present invention. The engine includes a cylinder unit or block 2 mounted on a support structure 4 to rotate about an axis $a_1$. The block 2 includes six cylinders 6 radially and uniformly arranged about the axis $a_1$, as best seen in FIG. 3. Each cylinder 6 is paired with a diametrically opposite cylinder as also best seen in FIG. 3. Pistons 10 are disposed to move within each cylinder 6, each piston being paired with and coupled to a piston of a diametrically opposite cylinder. Each such pair of pistons 10 is coupled by rods 8 and bearings 7 to a corresponding eccentric 11 which is integral with or mounted on a rotatable shaft 16 whose axis $a_2$ is offset from the axis $a_1$ about which the cylinder block 2 rotates. The rods 8 and eccentric 11 of FIG. 1 are split, as is eccentric 13 to which another pair of piston rods 9 (FIG. 3) is coupled. A remaining pair of pistons and rods 12 is coupled to eccentric 15 (FIG. 3). The centers of each of the eccentrics 11, 13 and 15 are spaced about the shaft 16 and apart from the center of the other eccentrics by 120° as shown in FIG. 3. The centers of the eccentrics, which correspond to the centers of the respective piston pairs, are further offset from the axis $a_2$. For example, the center $a_3$ of the vertically oriented piston pair of FIG. 3 is shown below the axis $a_2$ in the drawing. As the cylinder block 2 is caused to rotate, the piston pair centers, such as center $a_3$, are caused to revolve about a stationary axis $a_2$. This operation is fully explained in the aforecited Richards patent.

Referring again to FIG. 1, the cylinder block 2 is mounted by bearings 20 to rotate on the support structure 4. The shaft 16 is mounted by bearings 24 to rotate within the support structure 4. The shaft 16 extends through an opening in one side of the structure 4 to enable coupling a drive pulley or gear wheel to the shaft to thereby enable derivation of power from the engine. The other end of the shaft 16 is coupled to a standard distributor 17 which is mounted to the support structure 4. As the cylinder block 2 is caused to rotate by combustion of fuel charges in the cylinders 6, the pistons and rods coact with the eccentrics to cause the rotation of the eccentrics and thus of the shaft 16. Rotation of the shaft 16 causes rotation of a distributor shaft 19 to thereby control timing of the generation of spark pulses by an ignition coil 72. This, of course, is well known technology.

Formed integral with or mounted on each cylinder 6 is a cylinder head 14 which defines a passage 18 leading from the top of the cylinder to a cylinder port 22. A valve 26 is disposed in each cylinder head 14 so that the stem of the valve extends radially outwardly of a corresponding cylinder 6 through the top of the cylinder head. The valve 26 is movable between a closed position in which the valve head 30 seats over the cylinder opening to the passage 18 to close the passage, and an open position in which the valve head moves into the cylinder 6 to open the passage 18.

The top of each valve 26 is positioned to be contacted by one end of a rocker arm 34 pivotally mounted at 38 on the top of the cylinder head 14. The other end of the rocker arm 34 is contacted by a tappet 42 which is disposed to cam on a cam ring 46. The tappet 42 is held in place by a tappet holder 48 which is in the form of a ring mounted on the cylinder block 2 as shown. The tappet extends from the end of the rocker arm 34 through an opening in a flange 49 of the tappet holder 48 to the cam ring 46. The cam ring 46 is formed with an annular sleeve 50 projecting from the back of the cam ring to rotatably fit within a sleeve 51 formed in the tappet holder 48. The cam ring 46 is caused to rotate relative to the tappet holder 48 and thus relative to the cylinder block 2 by a gear wheel 52 which is mounted on the shaft 16. That is, an inner periphery 53 of the cam ring 46 includes a gear which coacts with and is driven by the gear wheel 52. As the cam ring 46 rotates relative to the cylinder block 2, and thus relative to the tappets 42, cam tracks 54 and 56 of the cam ring engage the tappets 42 to raise or lower the tappets, and thereby cause the corresponding valves to open or close. The operation of the cam ring 46, tappets 42, rocker arms 34 and valves 26 is described in detail in copending patent application, Ser. No. 593,003.

Mounted on the front of the engine of FIG. 1, and specifically on the tappet holder 48 is a cover 60 which, of course, rotates with the cylinder block 2. Mounted on the cover 60 is a spark ring 62 which is electrically coupled by conductors 64 to sparkplugs 66 mounted in the cylinder heads 14 to selectively discharge sparks in each of the cylinders 6. (Only one sparkplug 66 is shown in FIG. 1, but it should be understood that each of the cylinders 6 includes at least one sparkplug.) The sparkplug 66 advantageously would be mounted on one side of the valve 26 of the corresponding cylinder.

Figure 2:
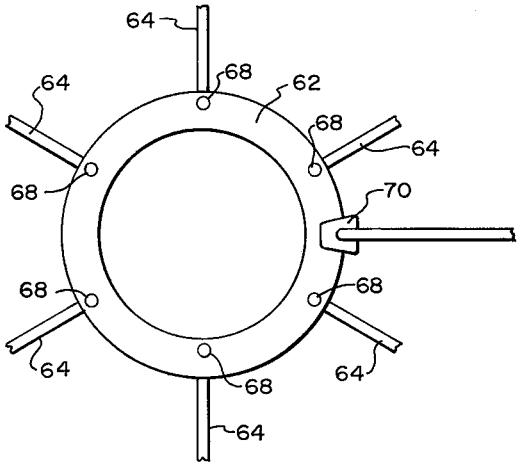
FIG. 2 shows a front view of a portion of the ignition apparatus of FIG. 1.

A front view of the spark ring 62 is shown in FIG. 2. As there indicated, a plurality of contacts 68 are exposed on the front face of the spark ring 62 and are connected to corresponding ones of the conductors 64 which, in turn, are coupled to a corresponding sparkplug. An ignition coil contact 70 is mounted in a fixed position so that as the cylinder block 2 and thus the spark ring 62 are rotated, the contacts 68 successively move into engagement with the ignition coil contact 70. That is, the spark ring 62 rotates relative to the ignition coil contact 70 to allow each of the contacts 68 to momentarily contact and receive current from the ignition coil contact 70. The distributor 17 times the spark pulses, in a conventional manner, by successively grounding a low voltage winding of the ignition coil 72 through operation of a set of standard ignition points (contact-breaker) located inside the distributor 17. That is, as the engine shaft 16 is rotated, the distributor shaft 19 is caused to rotate and operate the distributor ignition points. (The function of the high voltage portion of the distributor 17, of course, is performed by the spark ring 62, which serves to direct high voltage bursts of current from the ignition coil contact 70, through conductors 64 to the individual sparkplugs.) For simplicity, each cylinder may be sparked once every revolution even though it is to be fired only once every other revolution as will hereafter be described. Sparking the cylinders during their exhaust cycles, of course, will have no effect.

Fuel charges are supplied to the cylinder 6 by a fuel charge source 100 via a stationary intake and exhaust manifold 84 and a seal ring 58 to the cylinder passages 18 and thus to the cylinders 6. Exhaust products from the cylinders 6 are withdrawn from the cylinders by way of the cylinder passages 18 through the sealing ring 58, manifold 84 to an exhaust gas manifold 104. An air source 108 is also provided to supply fresh air to the cylinder passages 18 following injection of a fuel charge to thereby flush out the remnants of the fuel charge from the passages 18. The function and operation of the intake and exhaust system of the engine shown in FIG. 1 is fully explained in copending patent application, Ser. No. 593,004.

Operation of the rotary engine of the present invention will now be described by referring to FIGS. 4A through 4G which show successive positions of the cylinder block 2 as the cylinder block is rotated through two revolutions. In FIGS. 4A–4G, the cylinders are labeled *a* through *f* in the counterclockwise direction with cylinder *a* shown at top center in FIG. 4A. For the composite FIG. 4 views, the cylinder block 2 rotates in the clockwise direction as indicated by the arrows.

Figure 4A:
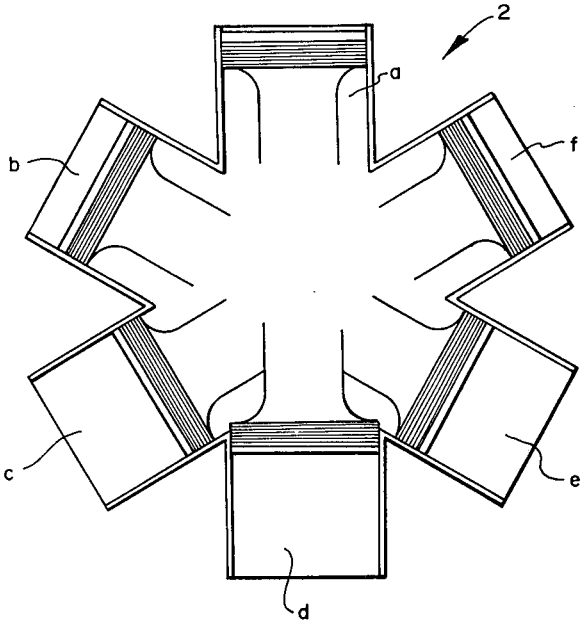
FIGS. 4A through 4G are diagramatic front views showing different phases of the operation of the rotary engine of FIG. 1.

In the position shown for the cylinder block 2 in FIG. 4A, a fuel charge previously introduced into and compressed in cylinder *a* is ignited, a fuel charge previously introduced into cylinder *b* is being compressed, cylinders *c* and *d* are exhausting products of a previous combustion, and cylinders *e* and *f* are receiving and drawing in fuel charges.

Figure 4B:
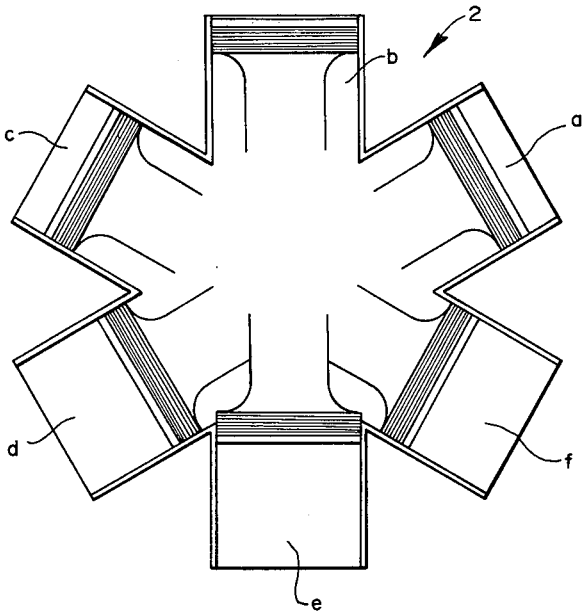

In FIG. 4B, the cylinder block 2 is shown having rotated 60 degrees in the clockwise direction from the position in FIG. 4A. In FIG. 4B, cylinder *a* is shown at a stage where the fuel charge in the cylinder is expanding following combustion, the fuel charge in cylinder *b* is just being ignited, cylinders *c* and *d* are still exhausting products of combustion, cylinder *e* is just completing intake of a fuel charge, and cylinder *f* is still drawing in a fuel charge. Thus, in FIGS. 4A and 4B, cylinders *a* and *b* are fired in succession.

Figure 4C:
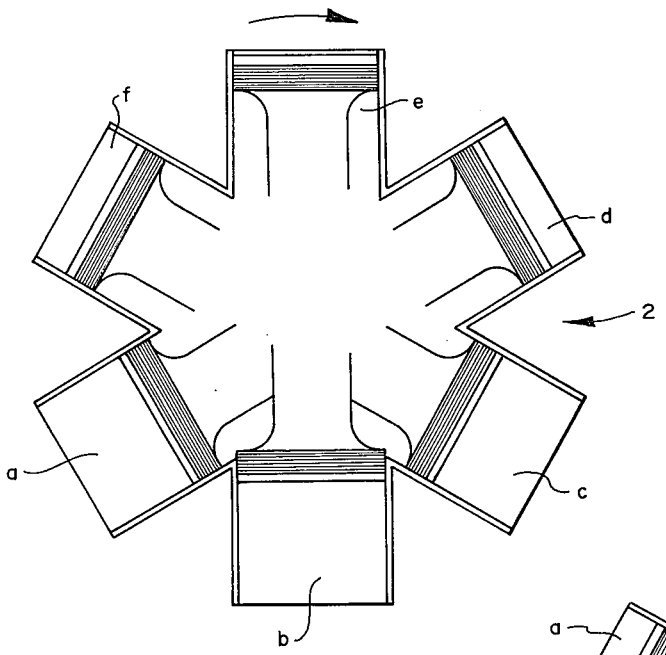
Figure 4D:
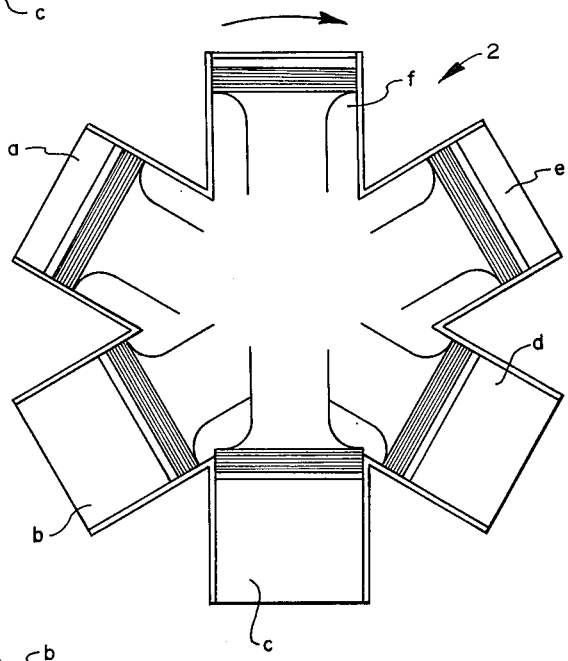

FIG. 4C shows the cylinder block 2 rotated through an angle of 180 degrees from the *c* 4B position. In FIG. 4C, cylinder *e* is just being fired, cylinder *f* is compressing a fuel charge in preparation for firing, cylinders *a* and *b* are exhausting products of combustion resulting from the firing which occurred in FIGS. 4A and 4B, and cylinder *c* and *d* are intaking fuel charges. In FIG. 4D, cylinder *f* is just being fired, cylinders *a* and *b* are still exhausting products of combustion, cylinder c is just completing the intake of fuel charge, cylinder *d* is still receiving a fuel charge and the fuel charge in cylinder *e* is expanding as a result of combustion.

Figure 4E:
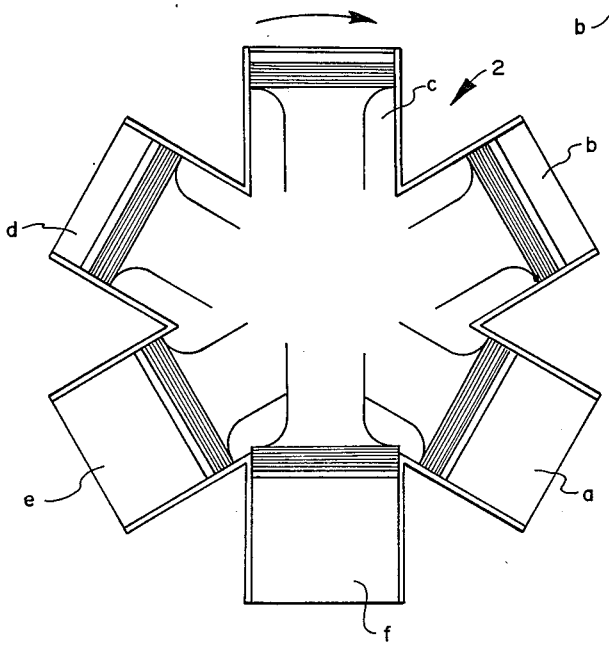
Figure 4F:
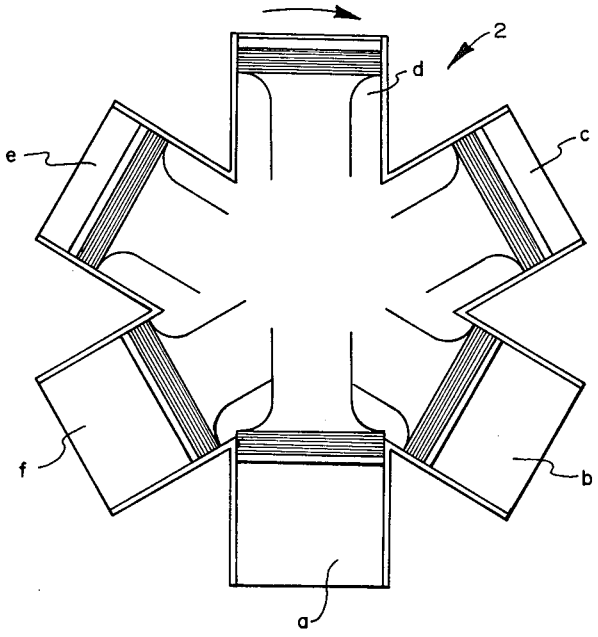

FIG. 4E shows the cylinder block 2 rotated 180° from the position of FIG. 4D. The cylinder block in FIG. 4F is rotated 60° from the position shown in FIG. 4E. In FIG. 4E, cylinder *c* is just being fired and in FIG. 4F, cylinder *d* is being fired. Thus, in FIGS. 4C through 4F, cylinders *e* and *f* were fired, cylinders *a* and *b* were skipped (although they may be sparked as previously mentioned, but not fired since they were exhausting products of combustion), and cylinders *c* and *d* were then fired.

Figure 4G:
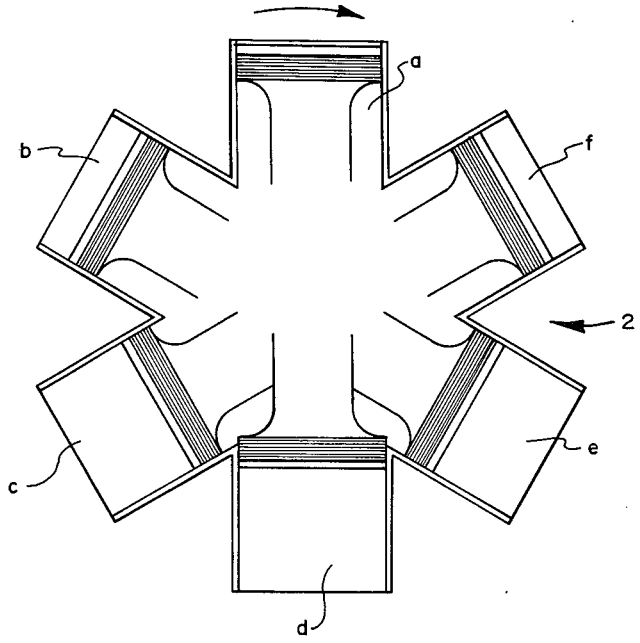

FIG. 4G shows the cylinder block 2 in the same phase of operation as that of FIG. 4A in which cylinder *a* is just being fired. From this point, the sequence of operation previously described is repeated. With the firing method disclosed, alternate pairs of adjacent cylinders are successively fired as the cylinder block 2 is rotated, with each cylinder being fired on every other one of its revolutions.

Because every cylinder is fired once every two revolutions and because adjacent pairs of cylinders are fired followed by the next adjacent pair not being fired, in turn followed by the succeeding adjacent pair being fired, etc., a smooth and even power development is accomplished.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A four-cycle rotary engine comprising a cylinder unit rotatable about a first axis and having six cylinders radially arranged about the axis, a piston system rotatable about a second axis which is offset from said first axis, said piston system including six pistons each disposed to reciprocate in a different one of the cylinders, means for introducing fuel charges successively into alternate pairs of adjacent cylinders and for exhausting combustion products therefrom, and ignition means for successively firing fuel charges in alternate pairs of adjacent cylinders.

2. An engine as in claim 1 wherein said ignition means is adapted to fire in succession the fuel charges in each cylinder of each pair fired.

3. An engine as in claim 2 wherein said ignition means is adapted to fire the fuel charge in a cylinder when that cylinder is at a predetermined angular position.

4. A four-cylinder rotary engine comprising a cylinder block disposed to rotate about a first axis, said block including $N=16, 10, 14, \ldots$ cylinders uniformly and radially arranged about said first axis, a set of N pistons disposed to reciprocate in a different one of said cylinders, and means of igniting fuel charges successively in alternate pairs of adjacent cylinders as the cylinder block rotates.

5. An engine as in claim 4 wherein said igniting means is adapted to ignite a fuel charge in each cylinder on every other revolution of the said each cylinder at a predetermined angular position of the cylinder.

6. A method of firing fuel charges in a four-cycle rotary engine having a rotatable cylinder unit defining six cylinders radially arranged therein, a set of six pistons, each disposed to reciprocate in a different one of said cylinders as the cylinder unit rotates, and a crankshaft coupled by piston rods to the pistons and disposed to rotate as the cylinder unit rotates, said method comprising successively introducing fuel charges to alternate pairs of adjacent cylinders as the cylinder unit rotates, with the cylinders of such a pair receiving fuel charges successively, and successively igniting the fuel charges in said alternate pairs of adjacent cylinders following introduction of the fuel charge.

7. A method of generating rotary power comprising providing a four-cycle rotary engine which includes a cylinder unit rotatable about a first axis and comprising six cylinders *a, b, c, d, e* and *f* radially positioned in succession about said axis, a piston system rotatable about a second axis offset from said first axis, said piston system including six pistons each disposed to reciprocate in a different one of the cylinders, and a crankshaft disposed to rotate as said cylinder unit rotates and the pistons reciprocate therein, said crankshaft including three eccentrics angularly spaced 120° apart, each eccentric coupled to a different pair of pistons, and firing the cylinders to cause said cylinder unit and crankshaft to rotate, said cylinders being fired in the order *a, b, e, f, c, d, a, b,* etc.

* * * * *